US006810948B2

(12) United States Patent
Peterson et al.

(10) Patent No.: US 6,810,948 B2
(45) Date of Patent: Nov. 2, 2004

(54) HEAT EXCHANGER

(75) Inventors: Gregory S. Peterson, Watertown, WI (US); Christopher T. Peterson, Lake Mills, WI (US); Lyle Clem, Dublin, OH (US)

(73) Assignee: Peterson Custom Stainless, Inc., Watertown, WI (US)

( * ) Notice: Subject to any disclaimer, the term of this patent is extended or adjusted under 35 U.S.C. 154(b) by 575 days.

(21) Appl. No.: 09/870,116

(22) Filed: May 30, 2001

(65) Prior Publication Data

US 2002/0011329 A1 Jan. 31, 2002

Related U.S. Application Data

(60) Provisional application No. 60/207,755, filed on May 30, 2000.

(51) Int. Cl.[7] ..... F28B 9/08

(52) U.S. Cl. ..... 165/111; 165/135; 165/158

(58) Field of Search ..... 165/111, 114, 165/135, 158, 159, 161

(56) References Cited

U.S. PATENT DOCUMENTS 1,816,850 A * 8/1931 Hurd ..... 165/160
2,336,879 A * 12/1943 Mekler ..... 165/83
2,381,006 A * 8/1945 Scott ..... 165/83
4,224,981 A * 9/1980 Datz et al. ..... 165/114
4,548,257 A * 10/1985 Williamson ..... 165/142
4,694,896 A * 9/1987 Navratil ..... 165/142
5,172,760 A * 12/1992 Hedrick ..... 165/114

* cited by examiner

*Primary Examiner*—Allen J. Flanigan
(74) *Attorney, Agent, or Firm*—Michael Best & Friedrich LLP

(57) ABSTRACT

A heat exchanger includes a shell having an open end and a closed end and defining a shell cavity. A steam inlet is located adjacent the closed end and communicates with the shell cavity to allow steam to enter the shell cavity. A flange is coupled to the shell adjacent the open end. The flange includes a first passageway communicating with the shell cavity for receiving a tube bundle, and a second passageway communicating with the shell cavity to allow condensate to drain from the shell cavity. Preferably, the shell has a longitudinal axis and the second passageway has a longitudinal axis that is oriented substantially normal to the longitudinal axis of the shell. The second passageway is positioned in the flange to allow condensate to the drain from the shell cavity regardless of whether the heat exchanger is oriented vertically or horizontally.

10 Claims, 6 Drawing Sheets

HEAT EXCHANGER

RELATED APPLICATIONS

This application claims priority to provisional application No. 60/207,755 filed May 30, 2000.

FIELD OF THE INVENTION

The invention relates to heat exchangers and more particularly to shell and tube heat exchangers.

BACKGROUND OF THE INVENTION

Shell and tube heat exchangers are well known and commonly used in the beverage and dairy industry to transfer heat from the plant steam supply to water or other liquid product. Heat exchangers used in these industries are commonly known as sanitary heat exchangers and must be made from approved materials and are subject to routine inspection. A typical prior art sanitary heat exchanger is shown in FIG. 1. The prior art heat exchanger 10 is designed to rest in the horizontal position supported by a stand or bracket (not shown). A stainless steel shell 14 houses a tube bundle 18 of stainless steel tubes 22. The shell 14 is open on one end to allow insertion and replacement of the tube bundle 18.

The shell 14 includes a flange 26 adjacent the open end of the shell 14. The tube bundle 18 includes a face plate 30 that engages the flange 26 and is secured to the flange 26 when a closure plate 31 is fastened to the flange 26 to seal the open end of the shell 14 and hold the tube bundle 18 in place. The shell 14 also includes a vacuum breaker 32 that allows air to enter the shell 14 and prevent vacuum buildup inside the shell 14.

As is commonly understood, liquid product is pumped into the tube bundle 18 at product inlet 34, circulates through the tubes 22 and exits the tube bundle 18 at product outlet 38. As the product circulates through the tubes 22, relatively low pressure steam enters the shell 14 at steam inlet 42. The steam circulates around the tubes 22 and transfers heat to the fluid product as is commonly understood. As the steam loses its heat, it condenses to water inside the shell 14. The condensate forms on the tubes 22 and falls to the bottom of the shell 14, eventually draining out through the condensate outlet 46. Typically, after installation, the outside of the shell 14 is wrapped with insulating material (not shown) to maximize the efficiency of heat transfer.

While these prior art heat exchangers 10 are designed to operate in the horizontal position shown in FIG. 1, it has been known to stand the heat exchanger 10 in a vertical orientation such that the product inlet 34 and product outlet 38 are at the bottom and the condensate outlet 46 is adjacent the top. The vertical orientation of the prior art heat exchanger 10 serves a number of purposes. First, the vertical orientation occupies less floor space in the plant which enables optimization of floor layout. Second, the vertical orientation allows the product to drain from the tubes 22 under the force of gravity when pumping stops.

SUMMARY OF THE INVENTION

Standing the prior art heat exchangers 10 in the vertical position presents a significant problem. When oriented vertically, the condensate outlet 46 is adjacent the top of the shell 14. The condensate that forms in the shell 14 cannot drain through the condensate outlet 46, but rather falls toward the open end of the shell 14 and collects adjacent the flange 26. Typically, the condensate fills the inside of the shell 14 at least to the steam inlet 42 and possibly even higher. This condensate accumulation is disadvantageous for several reasons. First, the condensate corrodes portions of the inside of the shell 14, the outside of the tubes 22, and portions of the flange 26 and face plate 30 that are in direct and constant contact with the accumulated condensate. This can cause the flange 26 and face plate 30 to corrode together, making replacement of the tube bundle 18 more difficult. Furthermore, corrosion can lead to product leakage from the tubes 22, condensate leakage from the shell 14 and the need for premature replacement of the shell 14, tube bundle 18 or both.

Second, the accumulated condensate lowers the efficiency of heat transfer in the heat exchanger 10. Some heat from the steam is transferred to the condensate instead of the product in the tubes 22. Additionally, the heated product passes through the accumulated condensate on its way toward the product outlet 38 and loses some of its newly obtained heat.

To alleviate these problems, the present invention provides a heat exchanger designed to permit substantially complete condensate drainage irrespective of whether the shell is oriented horizontally, vertically or somewhere in between. More specifically, the invention provides a heat exchanger comprising a shell having a closed end, an open end, a steam inlet near the closed end, and a condensate outlet near the open end. Preferably, the shell further includes a flange adjacent the open end, and the condensate outlet is in the flange. Further preferably, the heat exchanger also includes an insulating jacket surrounding the shell, wherein the insulating jacket includes an outer surface and an inner surface engaging the shell, and wherein the insulating jacket includes a metallic shroud on the outer surface.

Other features and advantages of the invention will become apparent to those skilled in the art upon review of the following detailed description, claims, and drawings.

Figure 1:
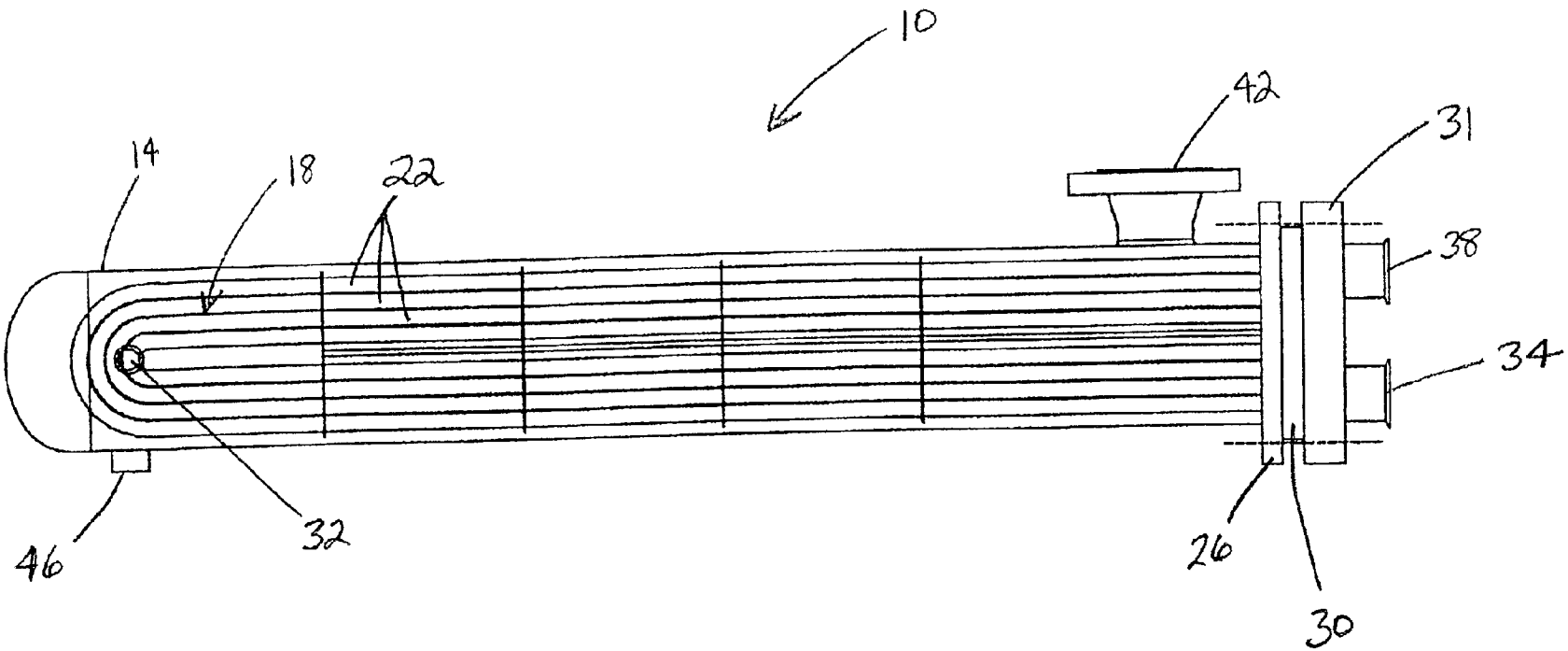
Fig. 1 Prior Art
FIG. 1 is a sectional view of a prior art heat exchanger.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIGS. 2–7 show the heat exchanger 100 of the present invention. The heat exchanger 100 includes (see FIGS. 2–3)

a shell 104, preferably made from stainless steel, having an open end 108, a closed end 112, and a longitudinal axis 114 extending in the direction from the open end 108 to the closed end 112. The shell 104 is preferably substantially cylindrical and includes an interior surface 116 and an exterior surface 120. Alternatively, the shell 104 could be substantially tubular having any suitable cross-section.

The shell 104 also includes a steam inlet 124 near the closed end 112, and preferably directly opposite the open end 108. The steam inlet 124 includes a steam inlet flange 128 adapted to be connected to a steam supply (not shown) as is commonly understood. The shell 104 also preferably includes a vacuum breaker 132 for preventing vacuum buildup inside the shell 104 due to temperature changes. Incorporation of a vacuum breaker 132 means that the shell 108 need not be designed to hold a vacuum. Preferably, the vacuum breaker 132 is near the closed end 112. Alternatively, the vacuum breaker 132 can be incorporated in the steam supply line (not shown).

A shell flange 136 is fixed to the open end 108 of the shell 104, preferably by welding. The shell flange 136 (see FIGS. 4 and 5) includes a first passageway 140 communicating with the open end 108, a second passageway or condensate outlet 144 having a longitudinal axis 145, and a reduced diameter seat portion 146. The purpose of the first passageway 140, condensate outlet 144 and seat portion 146 will be described below. The shell flange 136 and interior surface 116 of the shell 108 define a cavity 148, and the steam inlet 124, vacuum breaker 132, first passageway 140 and condensate outlet 144 all communicate with the cavity 148.

Figure 2:
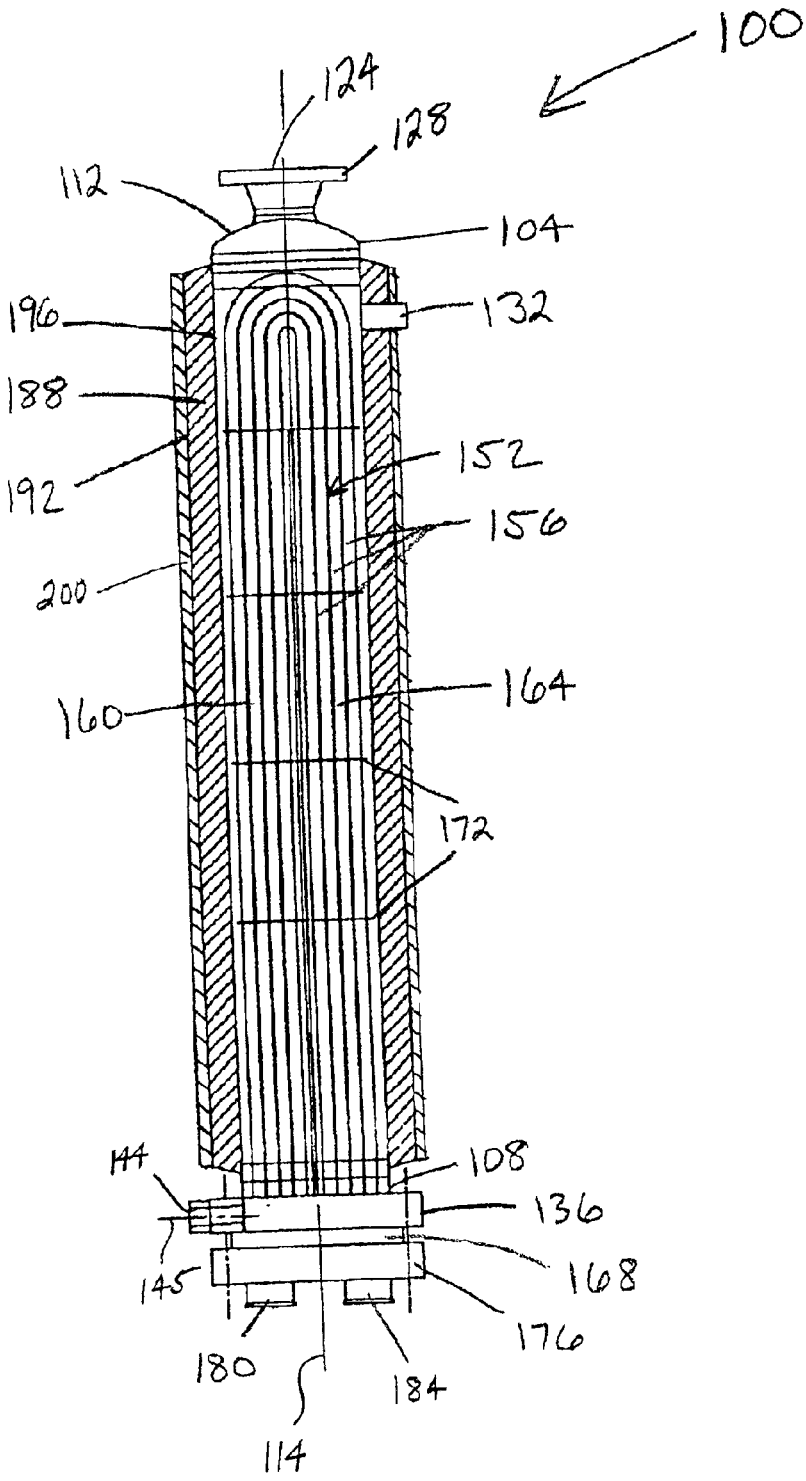
FIG. 2 is a sectional view of the heat exchanger embodying the present invention.
Figure 3:
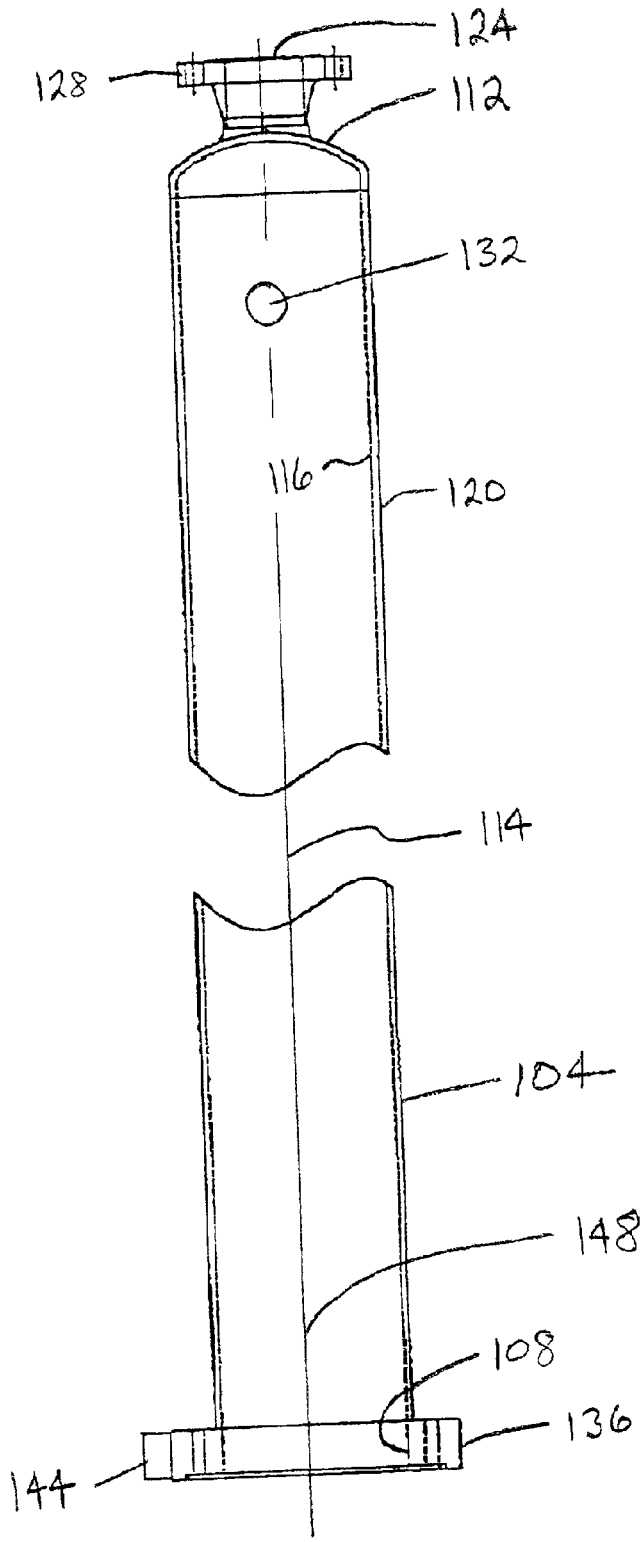
FIG. 3 is a sectional view of the heat exchanger shell and shell flange.
Figure 6:
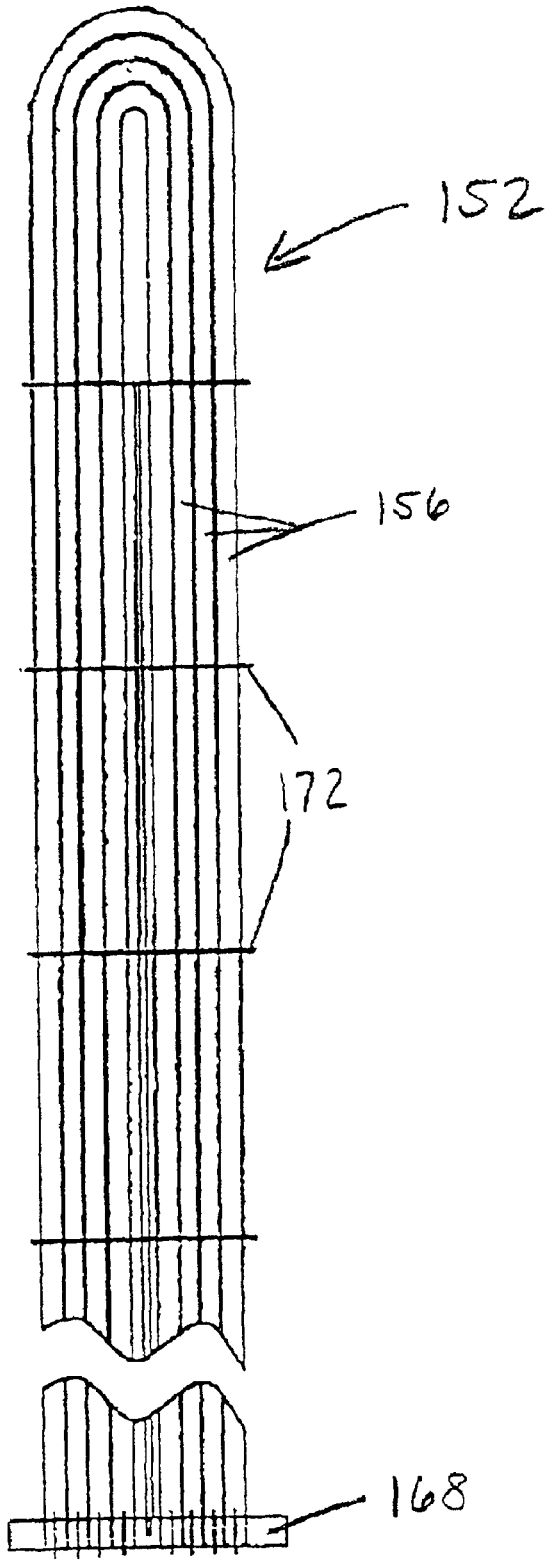
FIG. 6 is a side view of the tube bundle.

As seen in FIGS. 2 and 6, a tube bundle 152, including a plurality of individual stainless steel tubes 156, is removably located inside the cavity 148. In the preferred embodiment, the tube bundle 152 comprises a single tube pass or U-tube configuration as is commonly understood by those skilled in the art of shell and tube heat exchangers. Alternatively, the tube bundle 152 could be a multiple tube pass design. The tube bundle 152 includes a product inlet side 160 and a product outlet side 164.

The tube bundle 152 also includes a face plate 168 that supports the tube bundle 152. The face plate 168 houses the open ends of the individual tubes 156. Support members or baffles 172 are spaced along the tube bundle 152 and further support the individual tubes 156. The baffles 172 also provide barriers to the steam in the shell 104 to improve heat transfer as is commonly understood.

Figure 7:
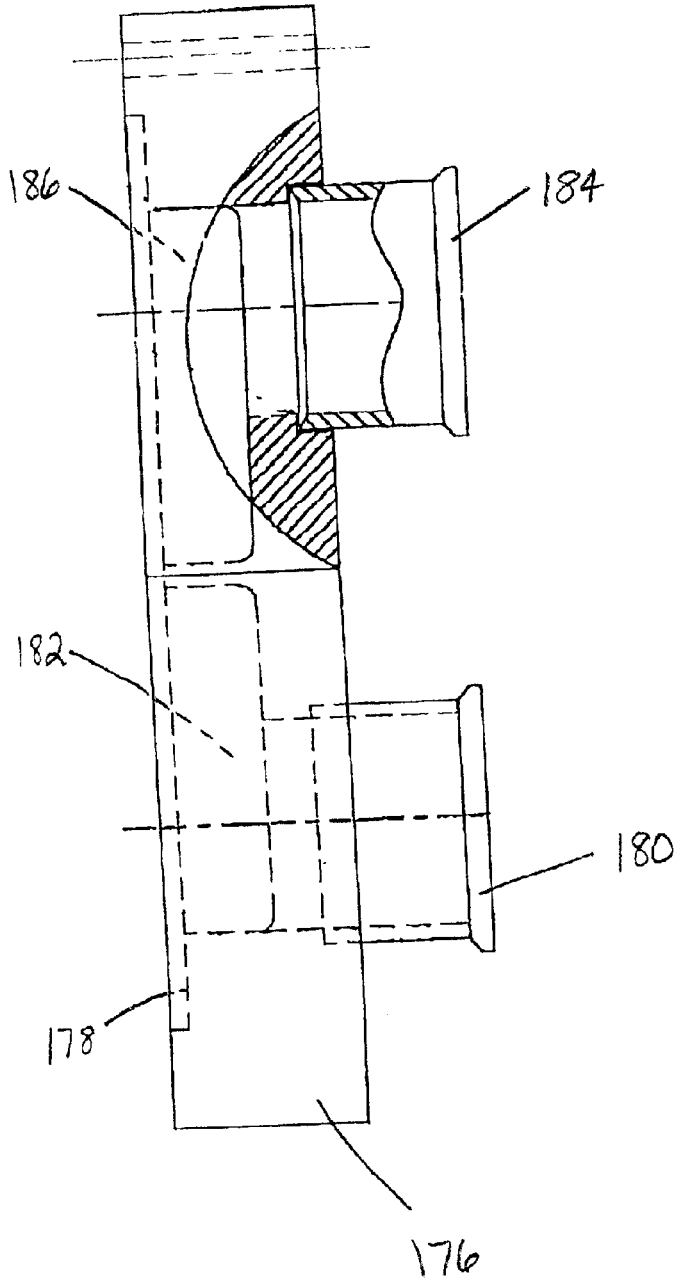
FIG. 7 is a side view, partially in section, of the closure plate assembly.

The tube bundle 152 is inserted into the cavity 148 through the first passageway 140 until the face plate 168 is received in the seat portion 146 of the shell flange 136. As seen in FIGS. 2 and 7, a closure plate 176 is placed over the face plate 168 and sandwiches the face plate 168 between the shell flange 136 and the closure plate 176. The closure plate 176 includes a reduced diameter seat portion 178 adapted to receive the face plate 168. The closure plate 176 also includes a product inlet 180, communicating with the product inlet side tubes 160 via inlet cavity 182, and a product outlet 184, communicating with the product outlet side tubes 164 via outlet cavity 186. The shell flange 136, face plate 168 and closure plate 176 are fastened together to seal the open end 108 of the shell 104. The fasteners (not shown) are preferably common mechanical fasteners such as nuts and bolts.

A gasket (not shown) can be placed between the shell flange 136 and face plate 168 to insure a substantially leak-proof seal of the shell 104. Another gasket (also not shown) can be placed between the face plate 136 and the closure plate 176 to insure a leak-proof seal between the inlet cavity 182 and the open ends of the inlet side tubes 160, and the outlet cavity 186 and the open ends of the outlet side tubes 164.

The heat exchanger 100 also includes (see FIG. 2) an optional insulating jacket 188 made from any suitable insulating material, including, for example, calcium silicate. The insulating jacket 188 improves the heat transfer efficiency of the heat exchanger 100. The insulating jacket 188 includes an outer surface 192 and an inner surface 196 that engages the exterior surface 120 of the shell 104. While the thickness of the insulating jacket 188 can vary, a thickness of approximately one inch is preferred. A metallic cladding or shroud 200 preferably surrounds the outer surface 192, thereby providing a sanitary appearance to the insulating jacket 188. Stainless steel is preferred for the metallic shroud 200.

In operation, liquid product is pumped into the product inlet 180 where it is directed by the closure plate 176 into the inlet side tubes 160. The product flows through the tubes 156 and exits through the closure plate 176 via the product outlet 184. Steam from the plant supply enters the cavity 148 via the steam inlet 124 and circulates inside the cavity 148, transferring heat through the individual tubes 156 and into the product as is commonly understood, so that the product exiting the heat exchanger 100 is warmer than the product entering the heat exchanger 100. As the heat is transferred to the product, the steam condenses into condensate which initially clings to the individual tubes 156 and then falls and exits the cavity 148 through the condensate outlet 144 in the shell flange 136. While the condensate outlet 144 is preferably in the shell flange 136 as described above, the condensate outlet 144 can alternatively be located directly in the shell 104, but should be near the open end 108. Additionally, while the longitudinal axis 145 of the condensate outlet 144 is shown as being oriented substantially normal to the longitudinal axis 114 of the shell 104, other orientations could also be used.

The position of the condensate outlet 144 (near the open end 108, or more preferably in the shell flange 136) allows the heat exchanger 100 to be used in a substantially vertical orientation, a substantially horizontal orientation or any orientation in between since the condensate outlet 144 can always be positioned such that gravity will allow the condensate to drain. As such, the heat exchanger 100 provides an advantageous new design over the prior art heat exchanger 10. When in the preferred vertical orientation as seen in FIG. 2, the condensate will fall (downward in FIG. 2) towards the shell flange 136 and drain through the condensate outlet 144. The location of the condensate outlet 144 overcomes the problem of condensate buildup and corrosion associated with orienting the prior art heat exchanger 10 in a vertical position.

Figure 5:
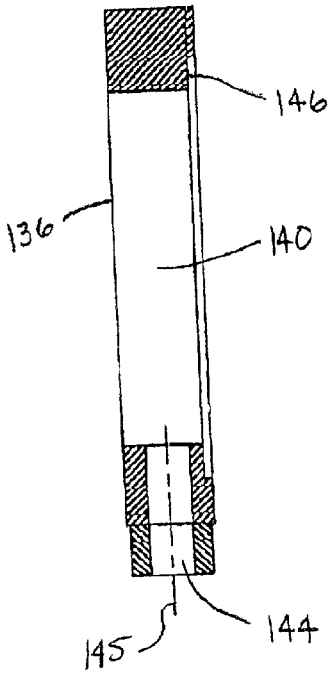
FIG. 5 is a sectional view taken along line 5—5 in FIG. 4.
Figure 4:
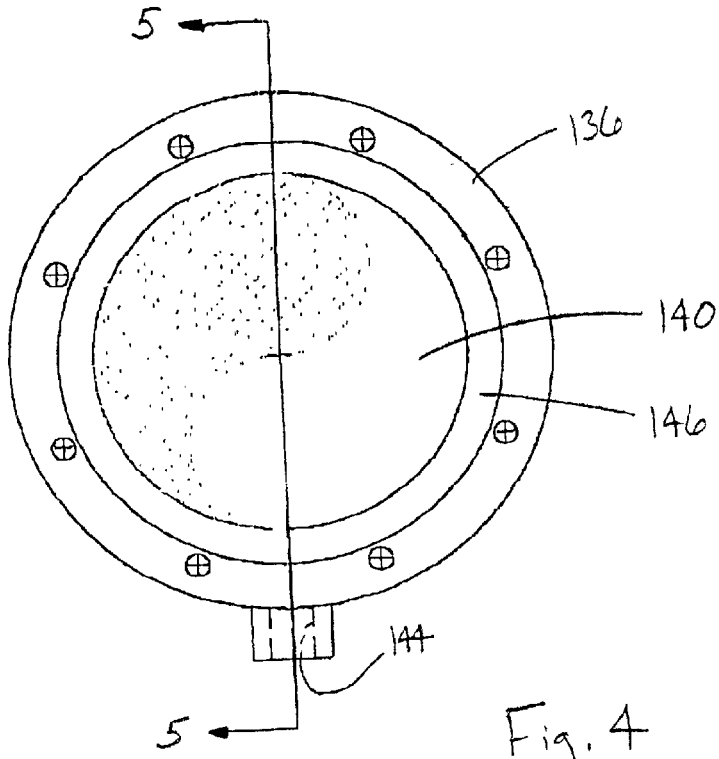
FIG. 4 is an end view of the shell flange.

The heat exchanger 100 of the present invention could, if desired, also be oriented horizontally such that the condensate outlet 144 would drain toward the floor (downward in FIGS. 4 and 5). Furthermore, while not typical, the heat exchanger 100 could be positioned in an orientation somewhere between horizontal and vertical and would still experience substantially complete condensate drainage.

Various features of the invention are set forth in the following claims.

What is claimed is:

1. A heat exchanger comprising:

a shell having an open end and a closed end and defining a shell cavity;

a steam inlet adjacent the closed end and communicating with the shell cavity to allow steam to enter the shell cavity;

a flange coupled to the shell adjacent the open end, the flange having therein a first passageway communicating with the shell cavity for receiving a tube bundle, and a second passageway communicating with the shell cavity to allow condensate to drain from the shell cavity, the flange further including a seat portion adjacent the first passageway, the seat portion adapted to receive a face plate coupled to the tube bundle; and a closure plate adapted to sandwich the face plate between the seat portion and the closure plate to substantially seal the open end of the shell.

2. The heat exchanger of claim 1, wherein the second passageway is positioned in the flange to allow condensate to the drain from the shell cavity regardless of whether the heat exchanger is oriented vertically or horizontally.

3. The heat exchanger of claim 1, wherein the shell has a longitudinal axis and wherein the second passageway has a longitudinal axis that is oriented substantially normal to the longitudinal axis of the shell.

4. The heat exchanger of claim 1, further including an insulating jacket surrounding the shell.

5. The heat exchanger of claim 4, wherein the insulating jacket includes an insulating layer surrounding at least a portion of the shell and a shroud surrounding at least a portion of the insulating layer.

6. The heat exchanger of claim 5, wherein the shroud is stainless steel.

7. A heat exchanger comprising:

a vessel defining a cavity and having an open end; and a flange fixed to the vessel adjacent the open end, the flange including an annular wall having extending therethrough an axial passage registered with the open end of the vessel and communicating with the cavity, and the annular wall having extending therethrough a radial passage communicating with the axial passages; wherein the annular wall has extending therethrough a plurality of axially extending bolt holes surrounding the axial passage, and wherein the radial passage is located intermediate a pair of the plurality of bolt holes.

8. A heat exchanger as set forth in claim 7 and further including a tube assembly fixed to the flange, the tube assembly including a tube bundle received by the axial passage and extending into the cavity and a face plate fixed to the flange and closing the axial passage.

9. A heat exchanger as set forth in claim 7 wherein the open end of the vessel is located above the radial passage in the annular wall.

10. A heat exchanger comprising:

an elongated shell defining an interior cavity extending along an axis between a closed end and an open end spaced from the closed end, the shell defining a steam inlet communicating with the cavity, the steam inlet being adapted to be connected to a steam supply;

a shell flange fixed to the open end of the shell, the shell flange including a first passageway communicating with the open end, a second passageway having a longitudinal axis, and a reduced diameter seat portion, the longitudinal axis of the second passage being substantially normal to the longitudinal axis of the shell;

a tube assembly housed by the shell in the cavity, the assembly including a plurality of tubes and a face plate supporting the tubes and received in the seat portion of the shell flange; and a closure plate fixed over the face plate, the shell flange, the face plate and the closure plate being fastened to seal the open end of the shell.

* * * * *